United States Patent [19]

Strydom

[11] 4,336,660

[45] Jun. 29, 1982

[54] DRYING OF TOBACCO PRODUCTS

[75] Inventor: Mauritz L. Strydom, Cape Province, South Africa

[73] Assignee: Tobacco Research and Development Institute Ltd., Zug, Switzerland

[21] Appl. No.: 200,426

[22] Filed: Oct. 24, 1980

[30] Foreign Application Priority Data

Oct. 25, 1979 [ZA] South Africa ..... 79/5710

[51] Int. Cl.[3] ..... F26B 21/06

[52] U.S. Cl. ..... 34/28; 34/46; 34/48; 34/52; 131/303

[58] Field of Search ..... 131/303, 304; 34/46, 34/48, 44, 52, 50, 25, 28, 31

[56] References Cited

U.S. PATENT DOCUMENTS

| | | | |
|---|---|---|---|
| 3,905,123 | 9/1975 | Fowler et al. | 34/46 |
| 3,948,277 | 4/1976 | Wochnowski et al. | 34/46 |
| 4,255,869 | 3/1981 | Quester et al. | 34/46 |

*Primary Examiner*—Larry I. Schwartz

*Attorney, Agent, or Firm*—Hammond & Littell, Weissenberger and Muserlian

[57] ABSTRACT

In tobacco cut rag being fed to a drier not only the moisture content of the cut rag is regulated to be constant, but the temperature of the cut rag is also regulated to be constant. In addition the dry mass flow rate is kept constant. Except for local temperature control to ensure constant heat exchange levels, the temperature in the drier and the subsequent cooler is kept constant.

4 Claims, 1 Drawing Figure

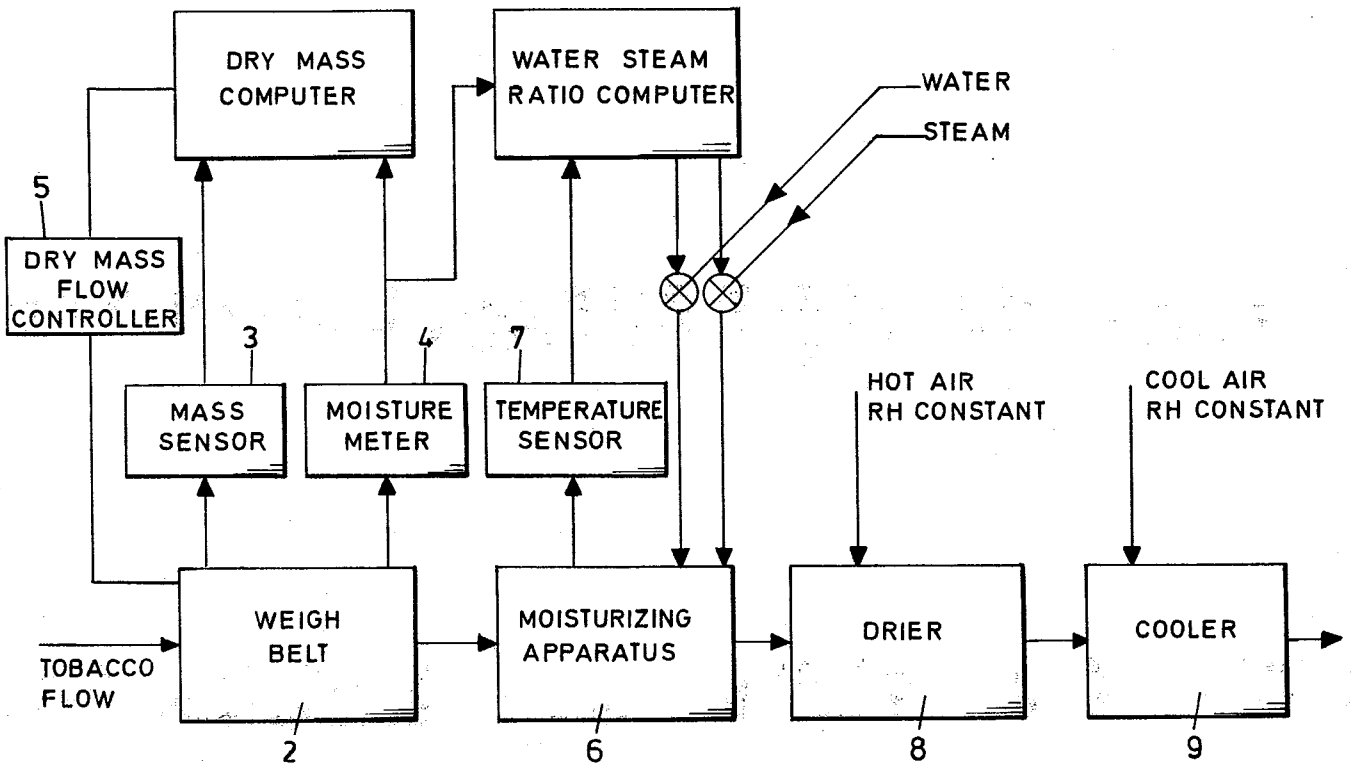
WATER
STEAM
WATER STEAM RATIO COMPUTER
DRY MASS COMPUTER
DRY MASS FLOW CONTROLLER
5
MASS SENSOR
3
MOISTURE METER
4
TEMPERATURE SENSOR
7
HOT AIR RH CONSTANT
COOL AIR RH CONSTANT
WEIGH BELT
2
MOISTURIZING APPARATUS
6
DRIER
8
COOLER
9
TOBACCO FLOW

DRYING OF TOBACCO PRODUCTS

BACKGROUND OF THE INVENTION

This invention relates to the drying of tobacco products such as cut rag, cut rolled stem and homogenised leaf.

The main object in the drying of tobacco products is to achieve a fixed moisture content with a very small standard deviation.

It has already been proposed to avoid variations in the control of the drying process, by premoistening the products to a constant moisture content before they enter the drying stage. In this proposal incoming tobacco is moistened by a combination of steam and water sprays to a constant moisture content. When this method was employed the quality of the tobacco improved, but there still was an unaccountable variation in the physical characteristics of the product.

The present invention is based on the discovery that the variation referred to above can be attributed to the variation in temperature in the drying stage.

In U.S. Pat. No. 3,905,123 it has already been proposed to compute the dry tobacco mass flow rate and to measure the temperature of the product. This information is used to control the drier. The present invention uses the same information, but makes use of it in a different manner.

SUMMARY OF THE INVENTION

According to the invention a method of cooling a tobacco product to a constant moisture content in which the product is premoistened to a constant moisture content prior to being fed to the drying stage has the improvement that:

(a) the rate of dry mass flow of the product is controlled to be constant;

(b) the temperature of the product, prior to being fed to the drying stage, is controlled to be constant; and (c) drying and cooling are effected by contacting the product with air at constant relative humidities and constant temperatures and by contact with heated surfaces at constant heat exchange levels.

Further according to the invention the product is premoistened by means of water and steam and the relative amounts of water and steam are controlled to control the temperature of the product.

The invention may also include the steps of sensing the moisture content and the mass flow rate of the product to control the dry mass flow rate of the product. The temperature of the product may also be sensed and together with the moisture content be utilised to control the temperature of the product.

Temperature control is conveniently effected by controlling the relative amounts of water and steam used for premoistening the product to be dried.

In the result conditions in the drier and any subsequent cooler are controlled simply by keeping a constant relative humidity in their atmospheres.

DESCRIPTION OF THE DRAWING

It is a flow chart illustrating the method of the invention.

DESCRIPTION OF A PREFERRED EMBODIMENT

In the drawing tobacco in the form of say, cut rag is fed onto a weigh belt 2 where the mass is determined by a sensor 3. The tobacco then passes a moisture meter 4 where the moisture content of the tobacco is determined. The flow rate to the belt is controlled after a computation of the moisture content and measured flow rate to keep the rate of feed of the dry mass constant by means of a flow controller 5.

In the next stage the tobacco is passed through a moisture addition apparatus 6 where the tobacco is moistened using steam and water. The combination of steam and water ensures that the moisture is rapidly absorbed by the tobacco. The amount of moisture added is determined by the moisture content measured in the moisture meter 4. The temperature of the tobacco which is sensed by a sensor 7 is kept constant during this stage by varying the ratio of the steam and water used to moisturise the tobacco in response to a temperature measurement. It is important to control the temperature of the tobacco as a variation in temperature during this stage results in a variation in consistency of the final product. At the end of this stage the tobacco has a fixed temperature, a fixed moisture content and a fixed dry mass flow rate.

The tobacco is now fed into a drier 8 in which a fixed amount of moisture is removed at a constant rate with the temperature and relative humidity of the air being fed to the drier being maintained at a constant level. As the drier also has heating walls on which dust may build up, there is a local control of the drier wall temperature to ensure constant heat exchange between the wall and the tobacco. After the moisture is removed the tobacco is cooled to a fixed temperature by air of fixed relative humidity and temperature in a cooler 9. In this case also there is local temperature control to ensure constant heat exchange levels.

The apparatus and controls used in the method of the invention are standard equipment which are known in the art of tobacco manufacture.

Description of the apparatus and controls have therefore been omitted.

EXAMPLE

In an example of the invention cut rag tobacco with a moisture content of about 20% by mass was controlled to flow at a rate of 5000 kg/h on a dry mass basis. The water/steam addition was computed to give a moisture content of 26%. The water/steam ratio was adjusted to give a product temperature of 65° C. In the drier the product contacted an air stream coming in at a temperature of 70° C. at a relative humidity of 60%. Initially the drier wall temperature was at 180° C., but this was adjusted upwardly as dust accumulated on the wall surface. In the cooler the product which was at 75° C. encountered air at ambient temperature and a relative humidity of 30%. The temperature of the wall surfaces was kept to about 1–2° C. above the ambient temperature.

The final product was a cut rag which had a moisture content of about 15%. Not only was the moisture content substantially fixed in the cooled product, but the product maintained the same optimum physical characteristics with no noticable variations.

Experiments with other tobacco products produced similar results. A constant final humidity was achieved without any significant variations in the ultimate physical properties. This success is attributed largely to the fact that during drying and cooling the product does not encounter temperature variations and to the fact that the dry mass flow rate through the system is kept constant.

I claim:

1. A method of drying and cooling a tobacco product to a constant moisture content in which the product is premoistened to a constant moisture content prior to being fed to the drying stage, with the improvement that:

(a) the rate of dry mass flow of the product is controlled to be constant;

(b) the temperature of the product, prior to being fed to the drying stage, is controlled to be constant; and (c) drying and cooling are effected by contacting the product with air at constant relative humidities and constant temperatures and by contact with heated surfaces at constant heat exchange levels.

2. The method claimed in claim 1 in which the product is premoistened by means of water and steam and the relative amounts of water and steam are controlled to control the temperature of the product.

3. The method claimed in either one of the above claims including the steps of sensing the moisture content and the mass flow rate of the product to control the dry mass flow rate of the product.

4. The method claimed in claim 3 in which the temperature of the product is sensed and together with the moisture content are utilised to control the temperature of the product.

* * * * *